US005458098A

United States Patent [19]

Yagi et al.

[11] Patent Number: 5,458,098

[45] Date of Patent: Oct. 17, 1995

[54] METHOD AND SYSTEM FOR STARTING AUTOMOTIVE INTERNAL COMBUSTION ENGINE

[75] Inventors: Toyoji Yagi, Anjo; Shigenori Isomura, Kariya, both of Japan

[73] Assignee: Nippondenso Co., Ltd., Kariya, Japan

[21] Appl. No.: 299,279

[22] Filed: Sep. 1, 1994

[30] Foreign Application Priority Data

Sep. 2, 1993 [JP] Japan ..... 5-218715

[51] Int. Cl.[6] ..... F02N 11/08

[52] U.S. Cl. ..... 123/179.3

[58] Field of Search ..... 123/179.3, 179.4, 123/179.28, 179.25

[56] References Cited

U.S. PATENT DOCUMENTS 5,323,743 6/1994 Kristiansson ..... 123/179.3

FOREIGN PATENT DOCUMENTS 61-38161 2/1986 Japan .

62-176552 8/1987 Japan .

3-3969 1/1991 Japan .

*Primary Examiner*—Andrew M. Dolinar

*Attorney, Agent, or Firm*—Cushman, Darby & Cushman

[57] ABSTRACT

A starting system and a method for starting an automotive internal combustion engine, the method and apparatus being capable of improving the starting ability of the engine. The starting system includes a starter motor, a means for measuring a crankshaft angle of the engine, and a control means which controls the entire system. The system is initiated by a start command being input thereto. The system, i.e., the control means, then preliminarily drives the starter motor in a reverse direction in a predetermined relation to the start command so that a load torque on the starter motor is reduced. Then, the control means of the system determines whether the reverse rotation of the starter motor has attained a predetermined value. Then, the starter motor is driven in a forward direction when the reverse rotation has attained the predetermined value.

11 Claims, 5 Drawing Sheets

METHOD AND SYSTEM FOR STARTING AUTOMOTIVE INTERNAL COMBUSTION ENGINE

BACKGROUND OF THE INVENTION

1. Field of the Invention

The present invention relates to a method and system for starting an automotive internal combustion engine. More particularly, the present invention relates to a method and system for starting an automotive engine designed to diminish load torque as the engine is started.

2. Related Art

Japanese Unexamined Patent Publication No. 3-3969 discloses improving the starting ability of an internal combustion engine by applying normal rotational torque for a constant time after receipt of a starting command or start of engine cranking. When a failure has occurred in starting the engine due to heat lock or the like, forward and reverse rotation of the starter is performed alternately in response to a starting command.

In such a system, after application of normal forward rotational torque, the system determines whether rotation stops after a given time. In this case, the system decides a starting failure only after the given time. Then, the system enters the reverse mode. This system creates the problem that considerable time is necessitated until the starting failure is detected. Therefore, even if the engine starting is successfully made by the reverse rotation after the failure in the first forward rotation, many operators are dissatisfied with the difficulty involved in starting the engine using such a system.

In the above prior art, the normal or forward rotation is performed first in each starting irrespective of direction of changes in the load torque which the starter should overcome at the very start of rotation. If the system carries out forward rotation at first and this is in the same direction as the load torque increase, the engine hardly rotates and may stop entirely. This is a waste of both time and effort, not to mention of electrical power.

SUMMARY OF THE INVENTION

It is an object of the present invention to overcome the above-noted difficulties with the prior art.

It is a further object of the present invention to provide a method and system for starting an internal combustion engine, which both improves the starting ability and shortens the time required to start the engine.

According to the present invention, a starter motor is first driven in a reverse direction for a short period, before being driven in a forward direction for engine starting in which direction the starter motor is normally driven for engine starting, so that the starter motor may start the engine by its forward rotation with reduced load torque applied thereto. The rotation in reverse direction may be initiated in various ways.

In a first aspect of the present invention, a control means initiates reverse rotation first as soon as a start command is input and then checks whether reverse rotation of a desired angle of rotation has been performed based upon the crank angle. Then the control means directs forward rotation in the normal direction for the intended engine starting.

In a second aspect of the present invention, the control means carries out preliminary reverse rotation of the starter motor to a position where the direction of load torque decreases, which is determined in accordance with the measured crank angle. Then, the starting system directs forward rotation for the intended engine starting.

This second aspect is based on the following findings.

If the crankshaft of the engine is at a position where load torque to the starter motor will decrease as normal rotation is performed, the starter motor can be driven in the direction of forward rotation immediately after starting, as normally occurs. Should the initial starting torque of the starter motor exceed the initial load torque including static friction resistance applied to the starter motor, the starter motor will be usually rotated normally with the load torque applied thereto gradually decreasing. On the other hand, if load torque to the starter motor decreases as reverse rotation is carried out, the starter motor is driven in the direction of reverse rotation immediately after starting. In such a case, if the initial starting torque of the starter motor exceeds the initial load torque including static friction resistance of the engine, the starter motor will be smoothly driven in the direction of reverse rotation. Since the above described reverse rotation, i.e., preliminary rotation, makes each frictional surface change to a quasidynamic frictional surface, where the coefficient of friction is decreased, due to the spread of oil, etc., the load torque (load resistance) decreases during the subsequent normal rotation, making it possible to improve the starting ability, as compared to the prior art where normal rotation is carried out immediately after receipt of the starting command.

Reverse rotation improves the starting ability of the internal combustion engine as follows. The load torque (load resistance) at the time of starting is caused by frictional resistance, the acceleration resistance, and the resistance of work such as gas compression. If these resistances are large, the forward rotation speed remains low and does not increase. During this period, the driving torque will become unable to exceed the load resistance because of increases in the resistance of work (such as gas compression), the consumption of battery power, or a partial increase in the frictional resistance, etc., any of which would make the rotation stop.

It is to be noted however that, if reverse rotation is carried out before normal rotation, each frictional surface for the next normal forward rotation becomes the surface where the reverse rotation has been carried out before. Since the condition of friction can be regarded as the condition of dynamic friction (where friction decreases as compared to the initial amount thereof), forward rotation can be carried out easier than in the above described first normal rotation, making it possible to start the internal combustion engine with ease.

BRIEF DESCRIPTION OF THE DRAWINGS

Other objects, features, and characteristics of the present invention will become apparent from a study of the present specification, which includes the detailed description, the claims and the appended drawings. In the drawings:

DETAILED DESCRIPTION OF THE PRESENTLY PREFERRED EXEMPLARY EMBODIMENTS

Figure 1:
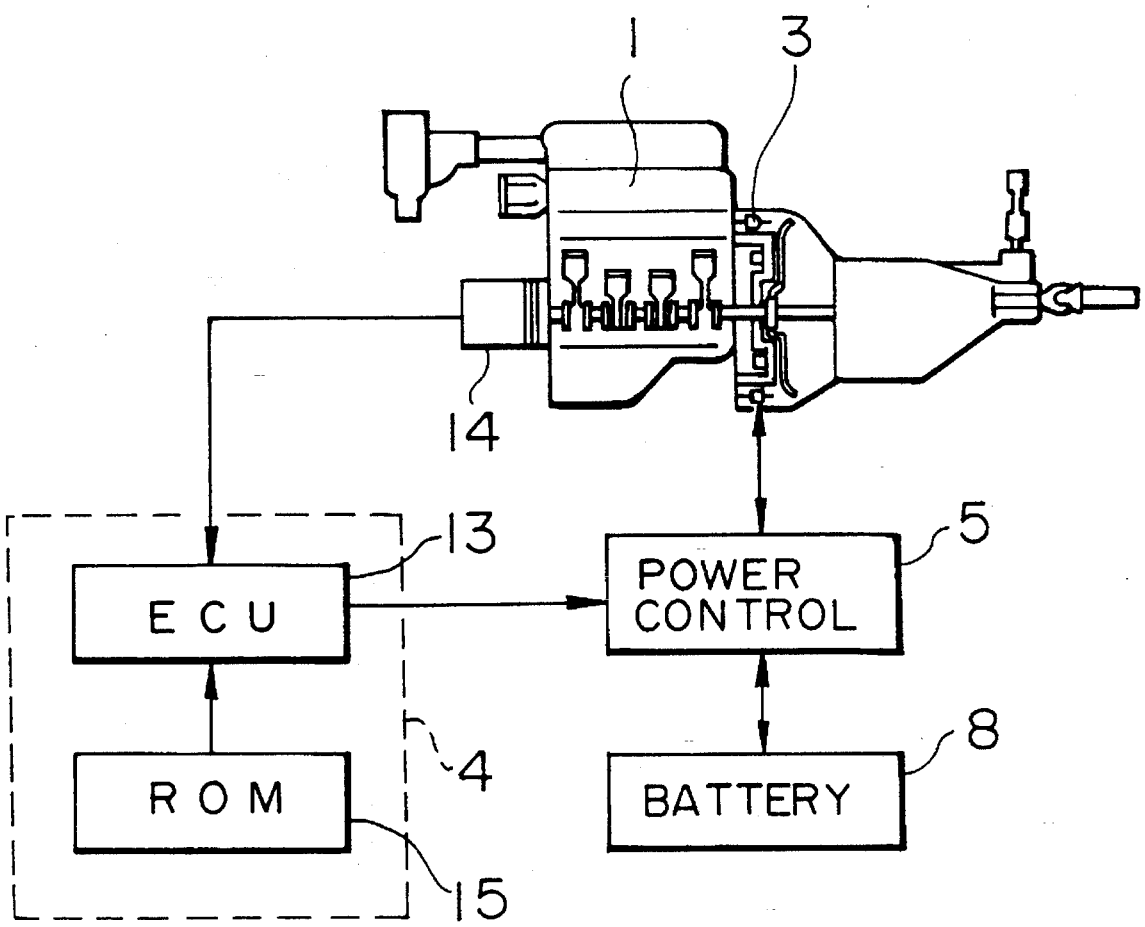
FIG. 1 is a block diagram illustrating a control system of a generator motor for an internal combustion engine.

The present invention will now be described with reference to FIG. 1.

An engine starting system according to the invention includes generator motor 3, which functions as both an electric motor and an electric power generator and is used as a starter motor. Generator motor 3 receives electrical power from a means for storing electric energy, e.g., battery 8, and is connected to a crankshaft of an internal combustion engine 1 of a vehicle for transmitting the torque therefrom. Electric power control unit 5 serves as part of the control means of the present invention. Control unit 5 makes generator motor 3 generate electrical energy and drive the internal combustion engine 1. Furthermore, control unit 5 controls the field current. Crank angle sensor 14 detects an angle of crankshaft using an absolute rotary encoder. Controller 4, which serves as the remaining part of the control means, controls the operation of generator motor 3 by controlling electric power control unit 5 depending on the signal from sensor 14. Controller 4 includes electronic control unit (ECU) 13, which is a computer that controls the internal combustion engine, and ROM 15, which stores various kinds of maps for the necessary control which will be described later.

Figure 2:
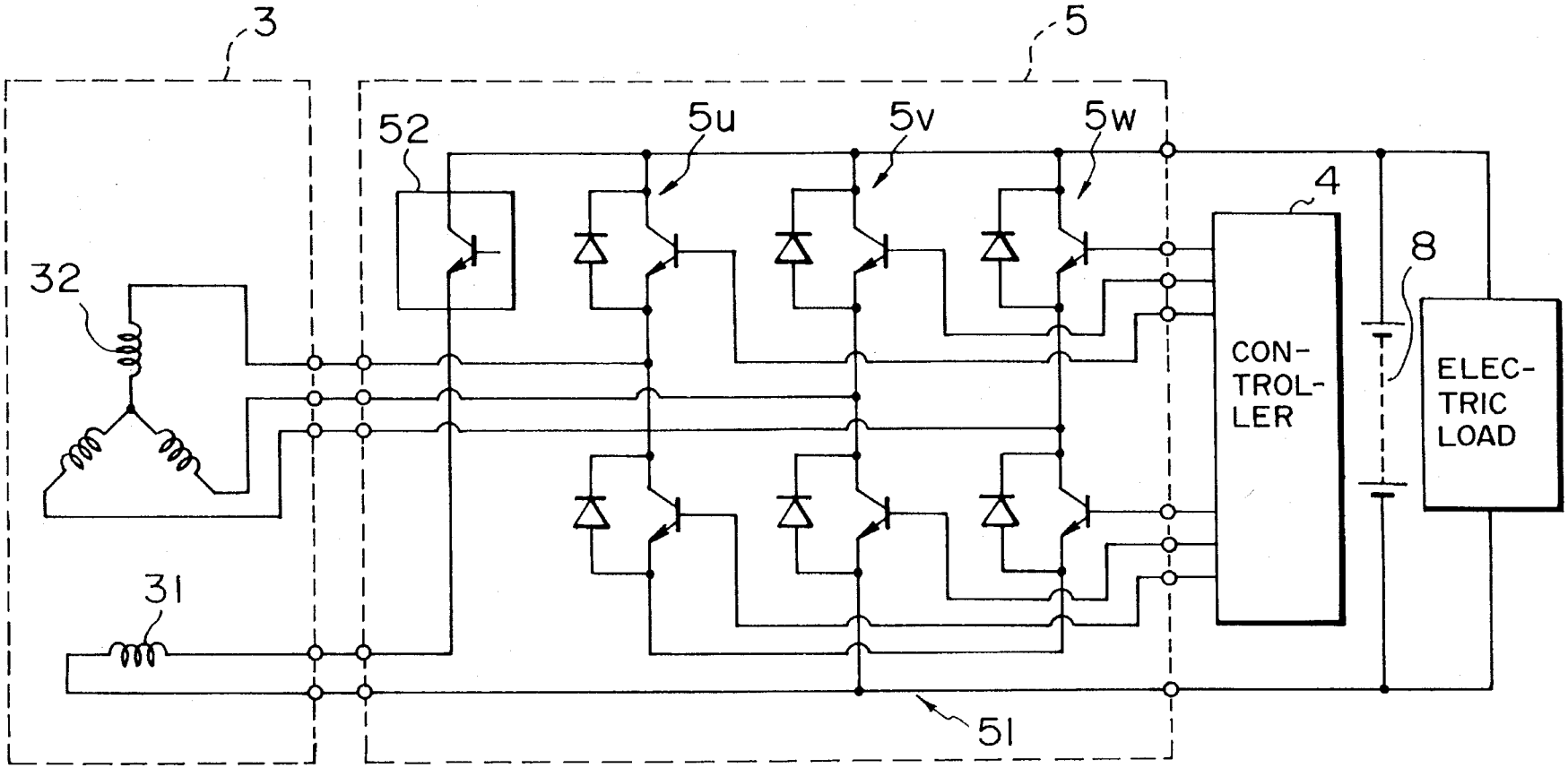
FIG. 2 is an electrical circuit diagram of the system shown in FIG. 1.

FIG. 2 shows an electric circuit diagram of this system.

Generator motor 3, i.e. a starter motor in this case, includes a three-phase synchronous electric rotary machine, where exciting coil 31 is installed on the rotor core (not illustrated) and star-connected three-phase armature coil 32 is installed on the stator core (not illustrated).

Electric power control unit 5 includes three-phase inverter circuit 51 whose transistor switches are controlled according to the crank angle, and transistor 52 for intermittently supplying the exciting current to excitation coil 31. Three-phase inverter circuit 51 comprises inverters for each phase 5*u*, 5*v* and 5*w*, respectively, in which npn transistors (or IGBT) are connected with diodes respectively, in parallel. Output contacts of the inverters for each phase 5*u*, 5*v*, 5*w* are connected with each output terminal of three-phase armature coil 32. One end of the exciting coil 31 is connected a low voltage or ground terminal of battery 8, and the other end is connected with a high voltage terminal of battery 8 through transistor 52.

By controlling switching timing of each transistor in three phase inverter circuit 51 according to instructions from ECU 13, it is possible to alternate between the generation of electrical energy (generator operation) and the supply of a driving force (motor operation). Also, the current duty ratio of the exciting current is controlled by turning on and off the transistor 52. Since the above structure is known and clear to one of ordinary skill in the art, a more detailed description is omitted for brevity. Generator motor 3 receives electrical power from battery 8 for driving engine 1 by its motor operation, and receives torque from the internal combustion engine 1 via the crankshaft for generating electrical energy by its generator operation.

Figure 3:
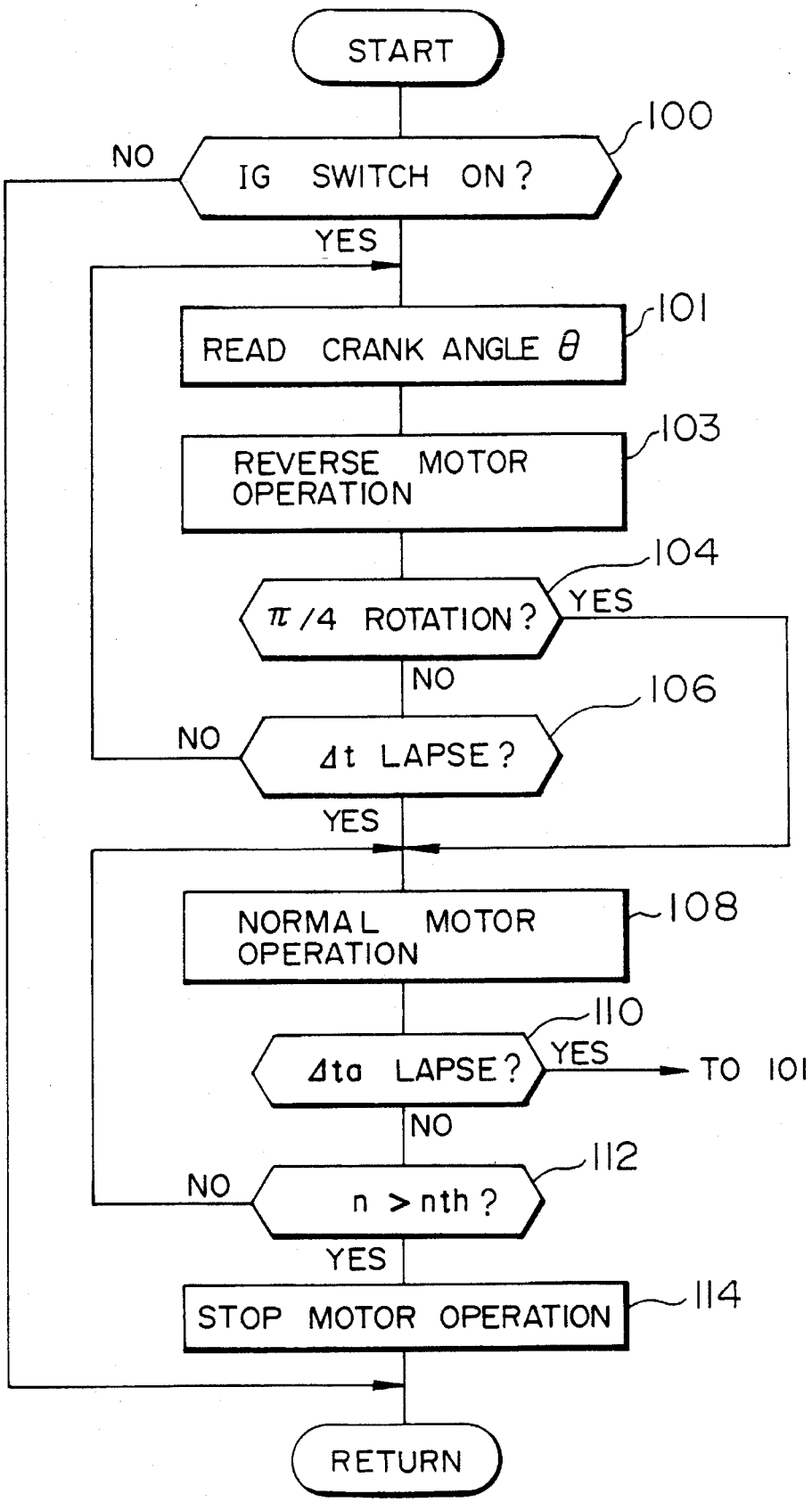
FIG. 3 is a flowchart of the control operation of the control system according to a first embodiment.

The operation of the control system according to the first embodiment is explained by referring to the flowchart illustrated in FIG. 3. This operation is performed by ECU 13.

First, whether or not an ignition switch (not shown) is turned on, i.e., whether or not start command is provided is decided. If it is NO, ECU 13 conducts other routines and repeats step 100 again after a predetermined time has elapsed.

When the ignition switch is turned on, crank angle $\Theta$ is read from crank angle sensor 14 in step 101. Each transistor in electric power control unit 5 is driven into the motor operation mode, based upon the crank angle $\Theta$, to make the generator motor 3 drive or apply its torque to internal combustion engine 1 in the reverse direction in step 103. Also, transistor 52 (FIG. 2) for supplying the field current in the control unit 5 is driven to apply field current having a 100% duty ratio so as to apply field current for the motor operation. Then, generator motor 3 is rotated in the direction of reverse direction with the maximum torque. Step 104 determines whether crank angle $\Theta$ of reverse rotation is $\pi/4$, and step 106 determines whether the time $\Delta t$ from the start of reverse rotation has elapsed in step 106. Step 108 is conducted when the result of step 104 or 106 is YES, but step 101 is conducted again when both determinations of steps 104 and 106 are NO. Step 101 is not performed again until a predetermined time elapses.

In step 108, each transistor in electric power control unit 5 is driven in the motor operation mode depending on absolute crank angle $\Theta$, to make generator 3 drive the engine 1 in the normal direction from its initial reverse rotation. Transistor 52 for supplying field current in electric power control unit 5 is directed to apply field current with a 100% duty ratio, similarly to the above step 103. Then, generator motor 3 is rotated in the direction of forward or normal rotation with the maximum torque.

Step 110 determines whether or not a given time $\Delta ta$ from the start of normal rotation has elapsed. When the result of the step 110 is YES indicating the continuation of motor operation for engine starting in excess of the given time, the starting of the internal combustion engine is considered a failure, and the processing returns to step 101 to once again carry out reverse rotation. When the result of the step 110 is NO, the engine speed n is checked to determine whether the engine speed n exceeds the threshold rotational speed $n_{th}$. This is determined via the crank angle $\Theta$ in step 112. When the result of step 112 is YES indicating rise of engine rotational speed, it is considered to have successfully started the internal combustion engine 1 and step 114 is conducted to stop generator motor 3 from its motor operation. When the result of step 112 is NO indicating insufficient rise in the engine rotational speed, step 108 is again performed so as to continue normal rotation.

In this embodiment, the cycle for starting the internal combustion engine 1, i.e., the cycle including both reverse and normal rotation, is performed whenever the given time passes until a desired rotation speed is obtained. Since the same frictional surface has been used until starting has been successfully accomplished, frictional resistance decreases gradually due to the spread of engine lubrication oil, etc., making it possible to improve the starting ability of the engine 1 and to avoid the consumption of excess electrical power.

Figure 4:
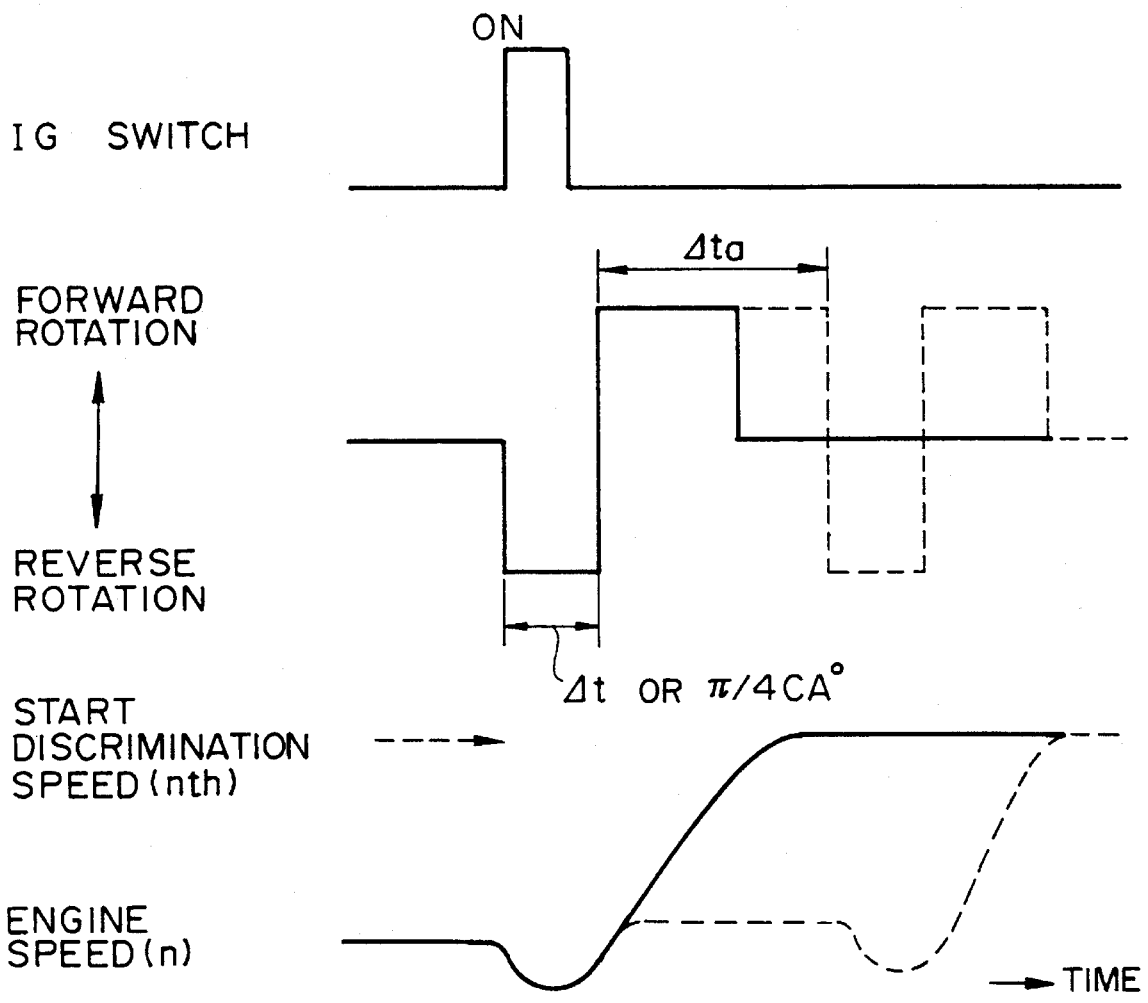
FIG. 4 is a signal diagram for the system according to the first embodiment.

FIG. 4 shows the operation of the first embodiment, where dotted lines represent the operation when reverse and normal rotation cycle is carried out two times.

It is to be noted in the above embodiment that, since load torque, i.e., load resistance, changes depending on the change in the crank angle (0 to $2\pi$), the above reverse and normal rotation cycle, the time for reverse rotation, and/or the angle of reverse rotation can be adjusted according to such changes. For example, in the range where the load torque is close to its maximum and it increases as normal rotation is carried out, starting is not easy. Therefore, repetition of the reverse and normal rotation cycle several times may be necessary to make rotation easy. If the load torque is near the minimum possible value and within the range where the load torque increases as normal rotation is performed, starting becomes easier. Therefore the reverse and normal rotation cycles may be performed only once to make rotation easy. Since starting is easy within the range where the load torque decreases as normal rotation is carried out, normal rotation may be carried out immediately. This makes it possible to improve the starting ability and avoid wasting electric power.

Figure 5:
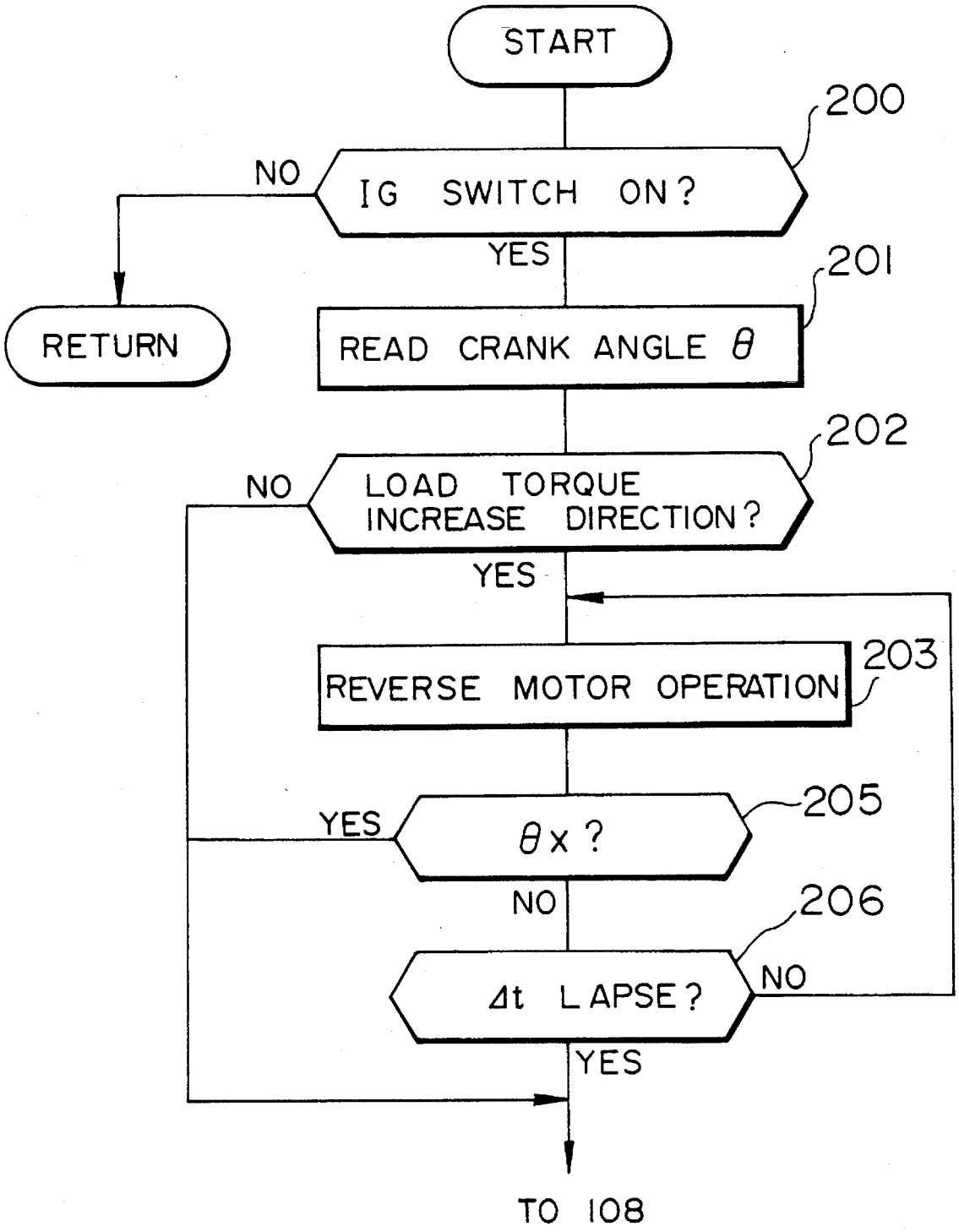
FIG. 5 is a flowchart of the control operation for a second embodiment of the present invention.

The second embodiment of the present invention is described next by referring to the flowchart illustrated in FIG. 5.

This embodiment is a modification of steps 101 through 108 of the first embodiment. First, it is determined in step 200 whether the ignition switch has been activated, i.e., whether a starting command has been provided. When no starting command is detected, the ECU 13 performs other routines for a predetermined time, before again checking to see if a start command is received.

When the ignition switch is turned on, crank angle Θ is read from crank angle sensor 14 in step 201. Then, step 202 checks whether the direction of normal rotation is in the direction of load torque increase at the present value of crank angle Θ read in step 201. Since the load torque, i.e., load resistance, of the internal combustion engine 1 changes depending on the crank angle Θ, the range of angles where the load torque increases as normal rotation is performed can be stored in the memory such as ROM 15. If crank angle Θ read in step 201 is within this range, it is easy to determine that the load torque increases as normal rotation is carried out. If not, it can be easily determined that the load torque increases as reverse rotation is carried out.

If the direction of normal rotation is the direction of load torque increase, generator motor 3 is rotated in the direction of reverse rotation in step 203 with maximum torque, i.e. with 100% field current. This step is similar to the step 103 of the first embodiment. This enables ECU 13 to determine, in step 205, whether the crank angle Θx is a little larger than the minimum value of the load torque, e.g., about 20% of the difference between the maximum and the minimum of the load torque, and to determine that the angle Θx is the angle where the load torque will decrease as normal rotation is performed. Step 206 corresponds to step 106 of the first embodiment in that it determines if a time Δt has elapsed.

In the case of driving based on crank angle Θx in the direction of normal rotation, the load torque decreases until the minimum of the load torque and frictional resistance decreases due to reverse rotation, making smooth acceleration possible. Though the load torque increases in the direction of normal rotation after that, the load torque is small enough to allow continued acceleration, thereby making it possible to exceed the maximum of the load torque using the inertial energy generated during acceleration.

If the result of step 202 is NO, step 108 of FIG. 3 is immediately conducted to carry out normal rotation because it is determined that load torque decreases as normal rotation is carried out.

The present invention has been described in connection with what are presently considered to be the most practical and preferred embodiments of the present invention. However, the invention is not meant to be limited to the disclosed embodiments, but rather is intended to encompass various modifications and alternative arrangements included within the spirit and scope of the appended claims.

What is claimed is:

1. A method for starting an internal combustion engine, said method comprising the steps of:

inputting a start command to a starting system;

preliminarily driving starter motor means of said engine in a reverse direction in a predetermined relation to said start command so that a load torque to said starter motor means is reduced thereby;

determining whether reverse rotation of said starter motor means has attained a predetermined value; and driving said starter motor means in a forward direction when said reverse rotation has attained said predetermined value.

2. A method according to claim 1, wherein said preliminary driving step includes the steps of:

driving said starter motor means in said reverse direction immediately in response to said start command.

3. A method according to claim 2, wherein said determining step includes the steps of:

measuring, during said reverse rotation, a value indicative of at least one of a crank angular interval of a crankshaft of said engine and a time lapse; and comparing said measured value with said predetermined value.

4. A method according to claim 3 further comprising the steps of:

measuring time lapse of said forward rotation of said starter motor means;

stopping said forward rotation of said starter motor means when said measured time lapse exceeds a predetermined time; and repeating said steps from said preliminary driving step after said stopping step.

5. A method according to claim 3, wherein said predetermined value is set to about a quarter radian ($\pi/4$) in crankshaft rotation angle.

6. A method according to claim 1, wherein said preliminary driving step includes the steps of:

measuring a first crank angle position of said engine upon receipt of said start command;

determining whether said measured first crank angle position corresponds to a direction of increase in load torque to said starter motor in case of forward rotation of said starter motor means; and driving said starter motor means in said reverse direction when it is determined that said measured first crank angle position corresponds to said load torque increase.

7. A method according to claim 6, wherein said preliminary driving step further includes the step of:

measuring, during said reverse rotation, a second crank angle position of said crankshaft; and comparing said measured second crank angle position with said predetermined value indicative of a crank angle position which corresponds to a decrease in said load torque.

8. A method according to claim 7 further comprising the steps of:

measuring time lapse of said forward rotation of said starter motor means;

stopping said forward rotation of said starter motor means when said measured time lapse exceeds a predetermined time; and repeating said steps from said preliminary driving step after said stopping step.

9. A method according to claim 7, wherein said predetermined value is set to a crank angle position where said load torque is close to and larger than a minimum load torque.

10. An internal combustion engine starting system comprising:

starter motor means adapted to be rotated in both forward and reverse directions to start an internal combustion engine;

means for measuring a crank angle of said internal combustion engine;

means for controlling said starter motor means according to the measured crank angle; and wherein said controlling means determines whether reverse rotation of said starter motor means is performed by a desired angular interval of rotation according to said measured crank angle after preliminary reverse rotation of said starter motor means is initially performed when a starting command is first received, and then said controlling means directs forward rotation of said starter motor means in the forward direction.

11. An internal combustion engine starting system comprising:

starter motor means adapted to be rotated in forward and reverse directions to start an internal combustion engine;

means for measuring a crank angle of said internal combustion engine;

means for controlling said starter motor means according to said crank angle; and wherein said controlling means determines whether a direction of forward rotation of said internal combustion engine is in a direction of load torque decrease or the direction of load torque increase according to the crank angle obtained from said measuring means at the time of a start command, and directs forward rotation after carrying out preliminary reverse rotation when said direction of forward rotation is the direction in which load torque increases.

* * * * *